United States Patent [19]

Kuhlemann et al.

[11] Patent Number: 4,880,425

[45] Date of Patent: Nov. 14, 1989

[54] BLOOD BAG HAVING LABEL PROVIDING ENHANCED GAS TRANSMISSIBILITY

[75] Inventors: Bruce W. Kuhlemann, Hayward; Agilio E. Macabasco; Renato R. Salumbides, both of San Dimas, all of Calif.

[73] Assignee: Miles Laboratories, Inc., Elkhart, Ind.

[21] Appl. No.: 618,716

[22] Filed: Jun. 8, 1984

[51] Int. Cl.[4] ..... A61J 1/00

[52] U.S. Cl. ..... 604/404

[58] Field of Search ..... 604/403–404, 604/408–411, 189; 383/103

[56] References Cited

U.S. PATENT DOCUMENTS

| | | | |
|---|---|---|---|
| 3,698,383 | 10/1972 | Bancom | 604/404 |
| 3,905,477 | 9/1975 | Graham | 604/189 |
| 4,132,594 | 1/1979 | Bank et al. | 604/405 |
| 4,222,379 | 9/1980 | Smith | 604/410 |
| 4,280,497 | 7/1981 | Warner et al. | 604/408 |

FOREIGN PATENT DOCUMENTS

| | | | |
|---|---|---|---|
| 1966731 | 1/1974 | Fed. Rep. of Germany | 604/410 |

*Primary Examiner*—C. Fred Rosenbaum
*Attorney, Agent, or Firm*—James A. Giblin

[57] ABSTRACT

Blood bag having affixed thereto a label, portions of which are adapted to permit enhanced gas transmissibility between the interior and exterior of the bag. In preferred embodiments the affixed label has an outwardly facing surface adapted to provide useful information about the bag or bag contents and an inwardly facing surface having raised portions and depressed portions with the label generally adhering to the bag surface via only the raised or selected raised portions.

7 Claims, 1 Drawing Sheet

BLOOD BAG HAVING LABEL PROVIDING ENHANCED GAS TRANSMISSIBILITY

BACKGROUND OF THE INVENTION

1. Field

This disclosure is concerned generally with the field of blood bags made from flexible polymeric materials and specifically with a blood bag and blood bag label combination which provides increased gas transmissibility for the blood bag.

2. Prior Art

Blood and blood components are commonly collected, processed, stored and administered in containers simply referred to as blood bags or blood bag systems. These are made from a flexible polymeric film which should be of a medically acceptable quality. The bags may exist as single bags having various access ports or multiple bags comprising two or more otherwise single bags in closed communication with one another via appropriate tubings which may include various valves or temporary seals. In the case of multiple blood bags, there are typically a so-called donor bag (or primary bag) into which whole blood is collected via attached tubing and attached donor needle and various satellite bags (or secondary bags). Into these various components or sub-components of whole blood may be expressed via connecting tubing after they have been separated (usually via centrifugation) in an attached bag, typically the donor bag or an additional satellite bag.

The above bags are commonly made from films of polyolefins, polyolefin mixtures, or polyvinyl chloride plasticized with plasticizers known in the art as di-2-ethylhexyl phthalate (DEHP or DOP) or, in some cases certain triesters of trimellitic acid such as tri-2-ethylhexyl trimellitate (TOTM or TEHTM). These films and the above PVC plasticizers are described more fully, for example, in U.S. Pat. No. 4,280,497 to W. Warner et al and U.S. Pat. No. 4,222,379 to D. Smith, the teachings of both being incorporated herein by reference.

It is known that certain blood components (particularly platelets) require an exchange of $CO_2$ and $O_2$ through the plastic collection bag during storage to remain viable. See, for example, U.S. Pat. No. 4,280,497 to Warner et al, cited above, and the publications cited therein. It has been found, for example, that when platelets are stored in a TOTM-plasticized PVC blood bag or certain polyolefin bags, a greater degree of gas transmissibility is possible. This greater gas transmissibility in turn permits better platelet storage properties (e.g. 5 days storage vs. 3 days), a desirable property.

Conventional blood banking practices require a relatively large (3"×4" or 4"×4") paper label be securely attached to the bag throughout the preparation, storage, and administration of a unit of blood or a blood component. This label may cover up to one fourth of the bag surface and, unfortunately, it has been found that the label may significantly reduce the amount of gas diffusion through the bag/label structure, thus, in some cases, impairing component viability.

Currently, paper labels are attached to a blood bag in either of two ways:

1. The more common heat seal method employs a heated platen which, with heat and pressure, melts the adhesive backing of the label and presses it into the bag film. About 100% of the inner label surface is then firmly attached to the bag.

2. A second method uses a label with a pressure sensitive adhesive backing which requires only pressure to attach it to the bag. A disadvantage of this method is that the label is not as firmly attached to the bag as with the heat seal method noted above. Accordingly, it is a preferred practice to use the above heat seal method for label attachment even though, because of its size and attachment, it interferes with gas diffusion through the bag.

Quite surprisingly, we have devised a blood bag-label combination which enhances or maximizes gas transmissibility while still permitting the label to be firmly affixed or attached via thermoplastic adhesive to the bag throughout common blood banking procedures. Details of our invention are disclosed below.

SUMMARY OF THE INVENTION

Our new blood bag system includes at least one blood bag having affixed thereto a label, portions of which are adapted to permit enhanced gas transmissibility between the bag interior and the bag exterior (e.g. the environment or atmosphere surrounding the label and bag). In preferred embodiments, the blood bag is made from a gas transmitting polymeric film (such as a plasticized PVC or certain polyolefins) and at least a portion of the bag's external surface has the blood bag label affixed to it. The label has an outwardly facing surface adapted to provide useful printed information about the bag or its contents and an inwardly facing surface. The inwardly facing surface is preferably coated with a thermoplastic adhesive and comprises raised and depressed portions with the label generally adhering to the bag surface via the adhesive only at the raised portions, or selected raised portions. In very preferred embodiments a heated "patterned platen" is used in applying the label to the bag and the platen is used to form the raised and depressed portions by pressing the label at elevated temperatures and pressures sufficient to activate the thermoplastic adhesive and bond the label. In yet another preferred embodiment, the blood bag is a platelet storage bag and the raised (adhering) portions of the inner surface of the label comprise less than about 50% (preferably less than 25%) of the inner surface area of the label. The depressed portions about the raised portions communicate with one another and the edge of the label via connecting channels to further facilitate gas transmission between the interior and exterior of the bag.

SPECIFIC EMBODIMENTS

It should be understood that the invention disclosed herein is particularly useful for labeled blood and blood component containers, especially labeled blood bags intended for use in any application where gas transmissibility through the container or bag is important. In the illustrative examples below we prepared a blood bag-label combination in which the bag was made from a TOTM-plasticized film of about 15 mils thickness. This type of bag has been found especially useful for platelet storage as pointed out in U.S. Pat. No. 4,280,497, cited above. Such platelet bags are commonly the secondary or satellite bags of a multiple blood bag system in which two or more bags are connected via appropriate tubing. Although the blood bag may be made from any film having gas transmissibility properties that may be enhanced with the labeling technique disclosed herein (e.g. various gas transmitting PVC materials, polyolefins and mixtures of polyolefins), a preferred film is made from a PVC film having a relatively large amount of plasticizer (e.g. more than 30% by weight plasticizer) and is similar to that described in the '497 patent. In the film of the examples, we used a PVC formulation comprising about 71 parts TOTM by weight per 100 parts per weight PVC resin, as well as conventional PVC additives known in the art.

The labels themselves were made from bleached kraft paper (conforming to surgical grade) having a basis weight of about 40–45 lbs. per ream. The labels were about 3"×4". On one side useful information about the bag, its manufacturer and the bag contents are printed. On the opposite side, a thin coat of adhesive is applied. For a thermoplastic bond, the adhesive may be any heat seal or hot melt formulation such as wax, polymers or wax/polymer combinations such as polyethylene wax known to those skilled in the art as useful for bonding kraft paper to flexible PVC films.

The bags to which the labels were applied were satellite bags of generally conventional size and volume and similar to those available commercially as CLX® blood bags from the Cutter Biological Division of Miles Laboratories, Inc., Berkeley, Calif.

Figure 1:
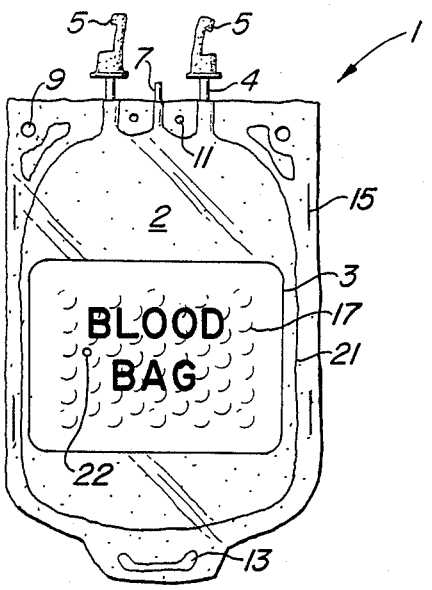
FIG. 1 illustrates a front view of the blood bag-label combination.

Further descriptions of the preferred labeled bags and how to make them are described better with reference to the Figures. FIG. 1 shows the front or label side of a typical generally flat, empty plastic blood bag 1 having affixed thereto the label 3 which is part of this invention. Bag 1 comprises two sheets (see sheets 2 of FIG. 4) of the PVC film edge sealed along line 21 and having conventionally placed access ports 4 and 7 and removeable access port protectors 5. In addition, the bag 1 has handling openings 9 and 11 for positioning the bag during bag handling operations, conventional longitudinal slits 15 for holding blood sample tubes, and hanger opening 13. Barely discernible on the face of label 3 is a honeycomb configuration consisting of slightly depressed portions 17 (which in FIG. 2 correspond to the similarly numbered raised portions). Although the label 3 of FIG. 1 simply shows the words "Blood Bag", in practice, other useful information would be printed on that face of the label. Also showing on label 3 is a tiny opening 22, about 1/16" diameter and conventionally placed on the label to assist in optical identification of the bag. It should be noted that this opening contributes essentially nothing of significance to the operation of the invention (i.e. enhancement of gas transmissibility through the bag).

Figure 2:
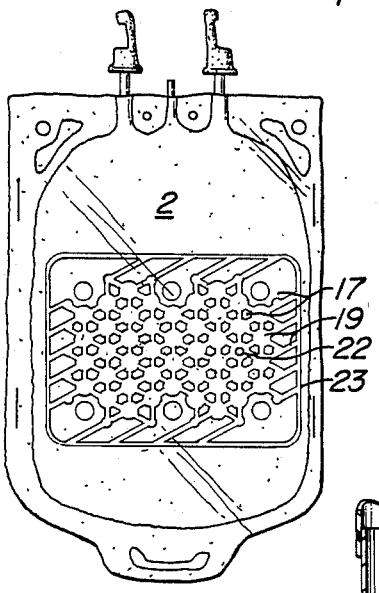
FIG. 2 illustrates the combination as seen from the opposite side through the essentially transparent, non-labeled rear portion of the bag of FIG. 1.

FIG. 2 illustrates the reverse side of bag 1 of FIG. 1. Since the PVC film of the preferred bags is essentially transparent, it is possible to look through the back of the bag to see in more detail how the label is affixed to the bag. As can be seen, the label adheres to the bag only at raised portions 17 (via adhesive portions 37 in FIG. 4) on the inner surface of the label 3. Surrounding these raised portions 17 are interconnected channels 19 which ultimately connect with the periphery of the label at label edges 23 which, in preferred embodiments, at least one of which is not bonded to the bag surface. Edges 23 need only be about 1/16" wide and by not adhering to the bag serve two purposes: (1) they permit channels 19 to communicate better with the atmosphere external to the bag, thereby facilitating gas transmission through that portion of the bag under the major part of the label, and (2) they assist in keeping the heat sealing patterned platen (described below) from making direct contact with the film per se during label application. In preferred embodiments, at least 50%, preferably at least about 75%, of the inner surface area of the label 3 does not adhere to the blood bag. Since this inner surface communicates with the outside atmosphere via interconnected channels 19 (and possibly via the adhesive coated portions of the inner label surface which do not adhere to the bag), gas transmissibility from the bag interior and around the edge(s) and through the label is enhanced.

Figure 3:
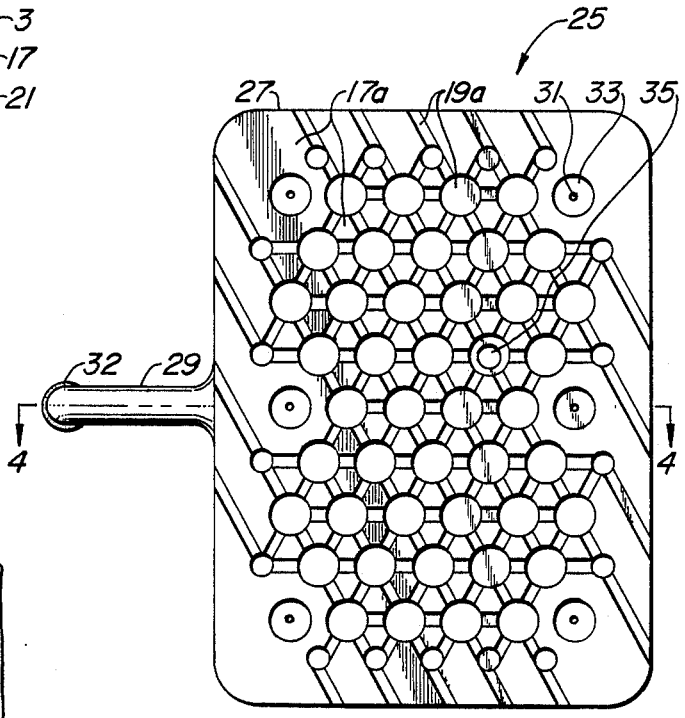
FIG. 3 illustrates the pressing surface of a "patterned platen" which may be used to create the blood bag-label combination.
Figure 4:
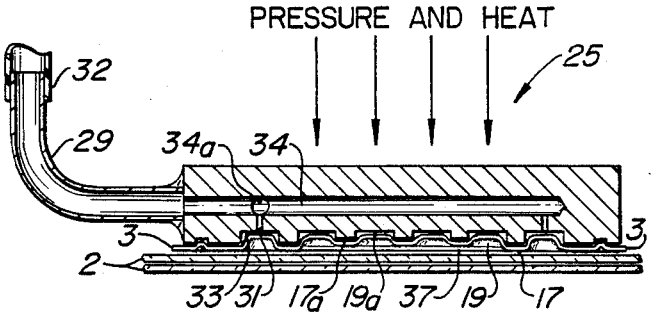
FIG. 4 illustrates a side cross section of the label just after it has been applied to the bag using the platen of FIG. 3.

The actual application of the label may be appreciated by reference to FIGS. 3 and 4. FIG. 3 illustrates the pressure face of an aluminum platen having a pressing surface area slightly less than that of the label surface area (to allow for non-adhering edges 23 in FIG. 2). The platen has a patterned working surface comprising selectively spaced raised portions **17*a* and depressed portions of interconnected channels 19*a* which communicate with the edges of the platen. Raised portions 17*a* (about 1/16" high) are intended for pressing label inner surfaces at selected points against the bag film to encourage adhesion (at points 17 in FIG. 2). Also shown on the face of the platen are six circular depressions 33 (about ½" in diameter and about 1/16" deep) having centrally located smaller vacuum openings 31 in sealed communication (not shown in FIG. 3 but seen as channels 34 in FIG. 4) with external tubing 29 integral with the platen edge as shown. In use, a partial vacuum generation means is connected at 32 on tubing 29 and a partial vacuum is created through channel 34 at the six larger circular depressions 33 via smaller openings 31. This is then used to position and hold in place a label to be applied to the bag. Item 35 of FIG. 3** is merely an opening for connecting the platen to a heat/pressure producing means and not an essential part of the invention.

The actual use of the patterned platen of FIG. 3 is illustrated in FIG. 4. There, platen 25 is shown in cross-section above label 3 which is placed over the top layer of blood bag films 2. On the inner surface of the label 3 facing film 2 is a thin layer of the thermoplastic adhesive 37 previously applied to the inner surface of the label.

When heat and pressure (for example about 300° F. and 30 – 80 PSI for one half to two seconds) are briefly applied to platen 25 (as illustrated by the downward pointing arrows), the label is then bonded to the top film 2. However, because of the pattern on the platen (see FIG. 3) the label assumes a honeycomb-like structure (especially on the bag film facing side) and the label adheres to the bag only at pre-selected, adhesive-coated raised portions 37 (corresponding to raised portions 17 in FIG. 2). The label does not adhere significantly to the film at depressed channel areas 19. Since these depressed areas 19 represent communicating channels which ultimately communicate with the atmosphere outside of the bag, the applied label enhances gas transmissibility between the interior and exterior of the bag. This then minimizes the normally deleterious effects on gas transmissibility caused by a label which adheres to the bag over the majority or all of its inner surface.

A TOTM-plasticized PVC platelet storage bag (described above) having a label applied as described above was compared for gas transmissibility with an unlabeled bag and a conventionally labeled bag (fully adhered label) with the results shown in the table below. The transmission of $O_2$ through the bags' total surface area was measured in all three cases using the method described by C. Chong et al in "Simple Rapid Method for Measuring Permeability of Platelet Storage Bags to Oxygen and Carbon Dioxide", Transfusion, Vol. 22, No. 5, Abstr. S-61, p. 418 (1982).

TABLE

| | $O_2$ Transmission, μ moles/hour/bag | | | | |
|---|---|---|---|---|---|
| Blood Bag | w/o Label | New Label | | Conventional Label | |
| Test Group | $O_2$ | $O_2$ | % $O_2$ | $O_2$ | % $O_2$ |
| #1 | 9.7 | 9.2 | 95 | 8.2 | 85 |
| #2 | 10.1 | 9.3 | 92 | 8.7 | 86 |

As can be seen, in two separate comparisons of the three test bags (unlabeled, new label and conventional label) the $O_2$ transmission is significantly better (less than 10% $O_2$ transmission loss) with the bag-label combination of this invention when compared with the conventional (fully adhered label). In subsequent tests, the bag-label combination of this invention was subjected to conventional tests for label adherence (centrifuging, freezing and subsequent thawing in water bath, and other blood banking procedures) and found to be successful.

It should be appreciated that the above-described blood bag-label combination and method of making it are our presently preferred embodiments. Given this disclosure, however, it is thought that variations will occur to those skilled in the art. For example, it is thought that similar enhanced gas transmission will be obtained by providing a label with numerous perforations which expose a significant portion of the film without interfering with label readability or by simply applying adhesive on the label at strategically selected locations which assure adhesion while simultaneously enhancing blood bag gas transmission because of the reduced surface area and adhering to the bag. Accordingly, it is intended that the exampkles disclosed herein should be considered illustrative only and that the invention should be limited only by the following claims.

We claim:

1. A blood or blood component container, the container demonstating gas transmissibility, and having affixed directly thereto a label, the label having an outwardly facing surface adapted to provide useful printed information and an inwardly facing surface, the inwardly facing surface having both raised and depressed portions, the raised portions comprising less than about 50% of the total inner surface area of the label and the depressed portions being interconnected and in communication with the periphery of the label to facilitate gas transmission between the interior of the container and the atmosphere surrounding the bag.

2. The blood bag system of claim 1 wherein the raised portions of the label comprise less than about 25% of the inner surface area of the label with the raised portions of the inner surface of the label being bonded to the bag by means of a thermoplastic adhesive.

3. The blood bag system of claim 1 wherein the loss in $O_2$ transmission attributable to the presence of the label on the bag surface is less than about 10% of the total $O_2$ transmission possible through the total surface area of the bag in the absence of a label.

4. The blood bag system of claim 1 wherein the gas transmissible polymeric material is a plasticized polyvinylchloride.

5. The blood bag system of claim 4 wherein the polyvinylchloride material is plasticized with at least about 30% by weight of plasticizer.

6. The blood bag system of claim 5 wherein the plasticizer is TOTM.

7. The blood or blood component container of claim 1 wherein the container comprises a polymeric material selected from the group consisting of polyolefins and plasticized polyvinylchloride.

* * * * *